United States Patent [19]

Kesselring et al.

[11] Patent Number: 4,519,770

[45] Date of Patent: May 28, 1985

[54] FIRETUBE BOILER HEATER SYSTEM

[75] Inventors: John P. Kesselring, Mountain View; Robert M. Kendall; Wayne V. Krill, both of Sunnyvale, all of Calif.

[73] Assignee: Alzeta Corp., Mountain View, Calif.

[21] Appl. No.: 487,068

[22] Filed: Apr. 21, 1983

Related U.S. Application Data

[63] Continuation-in-part of Ser. No. 164,831, Jun. 30, 1980, abandoned.

[51] Int. Cl.[3] ..... F23D 13/12

[52] U.S. Cl. ..... 431/7; 431/170; 431/328; 122/4 D

[58] Field of Search ..... 431/7, 170, 326, 328, 431/329, 350; 126/91 A, 92 AC, 92 C; 122/161, 4 D, 167, 169; 239/145

[56] References Cited

U.S. PATENT DOCUMENTS

| | | | |
|---|---|---|---|
| 3,383,159 | 5/1968 | Smith | 431/7 |
| 3,425,675 | 2/1969 | Twine | 431/328 X |
| 3,731,668 | 5/1973 | Smith | 431/329 X |
| 3,833,338 | 9/1974 | Badrock | 431/328 |
| 4,018,553 | 4/1977 | Baker et al. | 431/7 |
| 4,087,962 | 5/1978 | Beremand et al. | 431/7 X |
| 4,089,303 | 5/1978 | Brulfert | 431/328 X |
| 4,270,896 | 6/1981 | Polinski et al. | 431/328 |
| 4,311,447 | 1/1982 | Rackley et al. | 431/7 |
| 4,337,028 | 6/1982 | Angwin et al. | 431/7 |
| 4,400,152 | 8/1983 | Craig et al. | 431/328 |

FOREIGN PATENT DOCUMENTS

| | | | |
|---|---|---|---|
| 2018152 | 10/1979 | United Kingdom | 431/7 |

*Primary Examiner*—Margaret A. Focarino
*Attorney, Agent, or Firm*—Flehr, Hohbach, Test, Albritton & Herbert

[57] ABSTRACT

The burner system is adapted for retrofit into the combustion chambers of firetube boilers. The burner is comprised of a hollow shell molded from a porous ceramic fiber matrix. Fuel and air reactants flow outwardly through the fiber matrix shell and are combusted along a shallow reaction zone on the outer surface. Heat is transferred primarily by radiation to the walls of the combustion chamber at temperatures which result in relatively low $NO_x$ emissions and high combustion efficiencies as compared to boiler systems with conventional burners.

11 Claims, 10 Drawing Figures

FIRETUBE BOILER HEATER SYSTEM

This is a continuation-in-part of application Ser. No. 164,831 filed June 30, 1980, now abandoned.

The invention described herein was made in the course of or under a contract with the Environmental Protection Agency.

This invention relates in general to firetube boilers, and in particular relates to burner systems for use in new firetube boilers or retro-fit into existing boilers for achieving improved combustion efficiency and a reduction in harmful emissions including lower $NO_x$ emissions.

The firetube boiler is an important class of steam-generating equipment with, at present, approximately 125,000 gas-fired firetube boilers in the 600,000 to 3,000,000 Btu/hr firing range in the United States, and an additional approximately 3,000 new firetube boiler units are sold annually. These boilers produce approximately 150 ppmv $NO_x$ at 15% excess air, making gas-fired firetube boilers the 26th largest $NO_x$ source in the United States and accounting for 1% of the total $NO_x$ produced. In addition, firetube boilers are typically located in population centers where their effect on air quality is greater than the inventory percentage would otherwise indicate.

In improving air quality by reducing emissions from boiler systems it may be desirable from cost considerations to retrofit an existing boiler rather than replace the entire boiler. Toward that end, the U.S. Environmental Protection Agency has funded the development of low $NO_x$ burners for retrofit into existing boiler designs.

The present invention is an outgrowth of that funding, and the performance of the invention demonstrates that the objectives can be achieved in commercial size firetube boiler systems.

It is therefore a general object of the invention to provide a new and improved firetube boiler system incorporating a burner which achieves improved combustion efficiency with substantially lower $NO_x$ emissions.

Another object is to provide a burner adapted for retrofit into an existing firetube boiler with the resulting system operating at low $NO_x$ emission levels.

Another object is to provide a low $NO_x$ burner system of the type described having a burner heat release rate capability which matches heat absorption of the firewall for conventional boiler combustion chambers.

The invention in summary comprises a burner body in a hollow shell configuration formed by a porous matrix of ceramic fibers. The burner shell is sized and proportioned for retrofit into the combustion chamber of a firetube boiler. Fuel and air reactants enter the burner and pass through the fiber body with low $NO_x$ emission combustion taking place along the outer layer and with heat transferring primarily by radiation directly to the combustion chamber wall surfaces.

Figure 1:
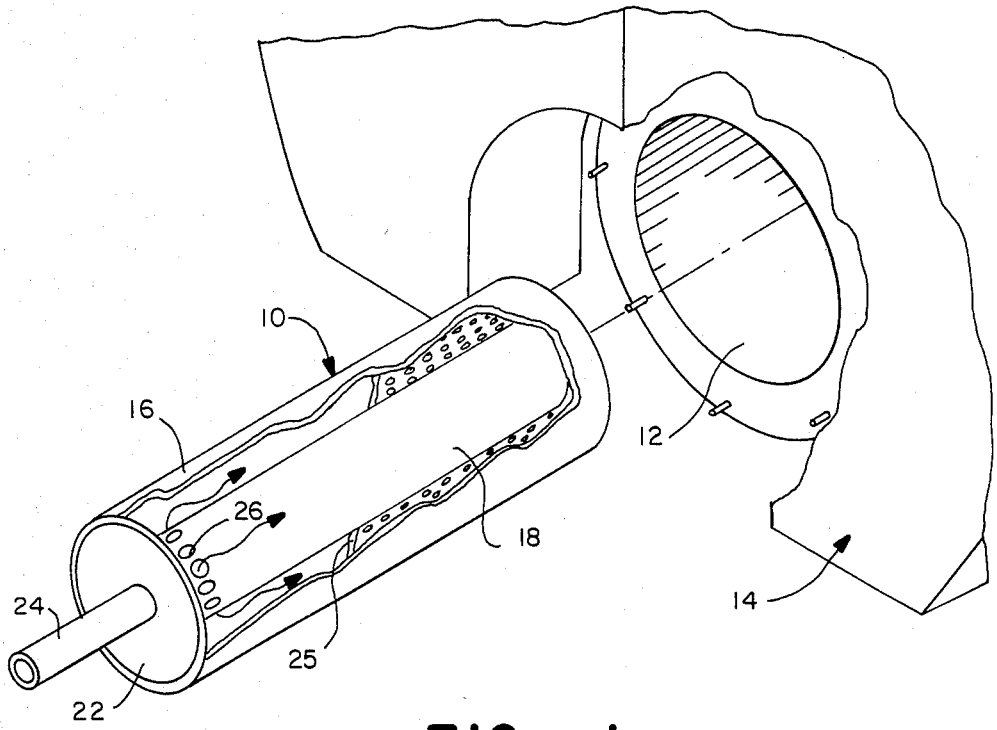
FIG. 1 is a perspective view, partially broken away and exploded, of a firetube boiler system incorporating the invention.
Figure 2:
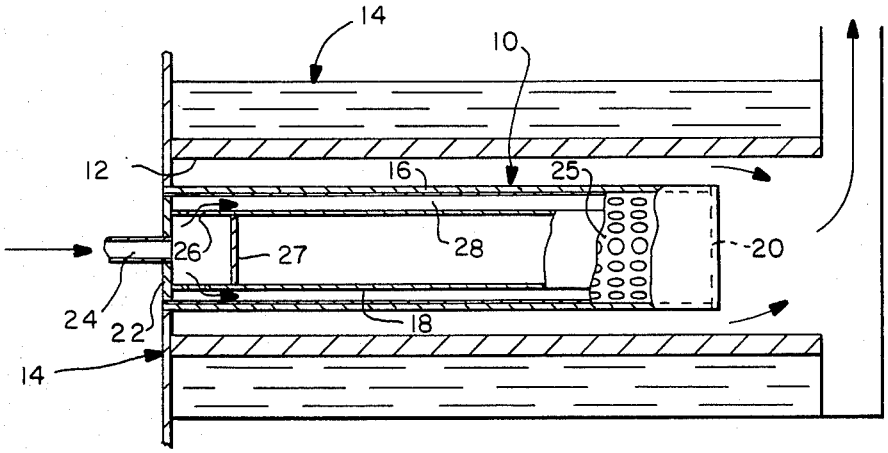
FIG. 2 is a schematic diagram of the firetube boiler system of FIG. 1 showing the burner in axial section.
Figure 3:
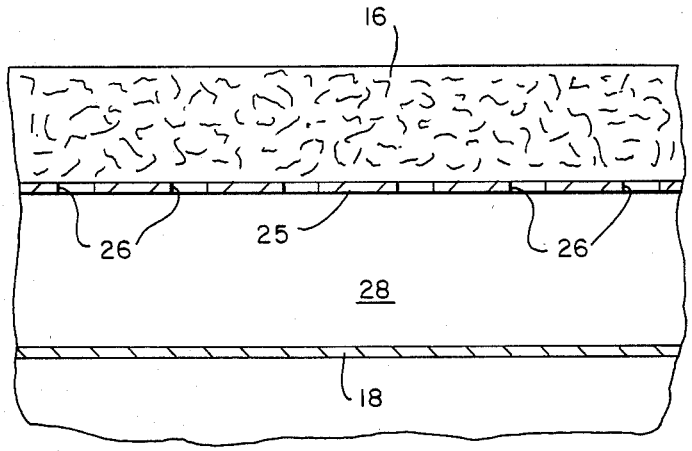
FIG. 3 is a fragmentary section view to an enlarged scale of the fiber matrix layer and support structure of the burner of FIG. 2.

Referring to the drawings and particularly FIGS. 1 and 2, a preferred firetube boiler system incorporating the invention comprises the burner 10 adapted for replacing conventional burners in firetube boilers. The burner 10 is sized and configured for retrofit into combustion chamber 12 in the first pass of a firetube boiler 14. The burner is of cylindrical shell configuration with the inner surface of the shell 16 radially spaced from a cylindrical centerbody 18. The centerbody forms a flow annulus to maintain high velocity flow of the reactants through the burner. The downstream end of the shell is closed by a cap 20 and the upstream end is sealed by a flange 22 through which an inlet conduit 24 extends. A perforated metal sleeve 25 is mounted about the inner surface of shell 16 to support the fiber matrix. Apertures 26 are spaced about the upstream end of the centerbody and a circular plug 27 is mounted across the centerbody to direct flow into the apertures. Premixed fuel and air is directed through conduit 24 into the centerbody and thence outwardly through the apertures into the annular volume 28 between the shell and centerbody.

The burner shell 16 is formed of fiber matrix layers comprised of randomly oriented ceramic fibers 29. The cap 20 can be of suitable high temperature insulation material or, as desired, it can be comprised of fiber matrix layers similar to that of the burner shell. The ceramic fibers are packed in the layers to an optimum density to form interstitial spaces which provide a flow path for the fuel-air mixture over the entire extent of the matrix. Preferably the fiber matrix is of the composition described in U.S. Pat. No. 3,383,159 to Smith which is hereby incorporated by reference. As generally disclosed in the Smith Patent, the preferred fibers are inorganic and are comprised of substantial portions of both alumina and silica. Other fibers that can be employed are such inorganic fibers as quartz fibers, vitreous silica fibers, and other generally available ceramic fibers. Powdered aluminum is added to the fibers in slurry form prior to molding into the burner configuration.

The catalytic activity of the fiber matrix can be improved by the addition of materials having a higher degree of catalytic activity, e.g. strands of a catalytic metal such as chrome wire can be interspersed through the matrix. In addition, the matrix can be formed in two or more separate layers, each having different densities or different compositions. Thus, for controlling flashback the layer on the upstream side can be of a composition which is less catalytic than the downstream layer, and the strands of catalytic metal can be contained in only the downstream layer.

Burner shell 16 is molded into the desired configuration for retrofit into the combustion chamber, and it is most advantageous to utilize the vacuum-forming procedures described in U.S. Pat. No. 3,275,497 to Weiss, which is hereby incorporated by reference. In the method of manufacture facture a liquid slurry of the ceramic fibers, a refractory metal compound such as aluminum and a binder (as disclosed in Smith U.S. Pat. No. 3,383,159) are vacuum-formed onto a mold about the perforate sleeve 25. This is followed by low temperature heating to evaporate water from the slurry and then high temperature firing. The fiber matrix shell is mounted on flange 22 about centerbody 18, and the burner 10 is then installed in the first pass of the combustion chamber 12 of the firetube boiler.

In operation of the boiler system incorporating burner 10, combustion air is pre-mixed with natural gas injected into ports, not shown, upstream of the burner. The reactants enter the burner through conduit 24 and pass through apertures 26 into volume 28. Centerbody 18 reduces the cross-sectional flow area to minimize the premixed gas volume and maintain the gas and air mixture at a high velocity. The reactants pass through the porous fiber matrix of burner shell 16 and are ignited on the outer surface of the matrix with a suitable source such as a standing pilot flame, not shown.

Heat is transferred from the burner primarily by radiation to the combustion chamber surfaces. In the boiler's subsequent small diameter passes, heat is transferred primarily by convection from the gases to the tube wall surfaces. This is in comparison to conventional boiler systems where heat transfer in the first pass is primarily by convection with some radiation, and with all convection heat transfer in the subsequent passes. With the present invention utilizing primarily radiative heat transfer in the first pass, the total heat flux to the boiler wall surfaces is improved over that of conventional boiler systems.

Figure 4:
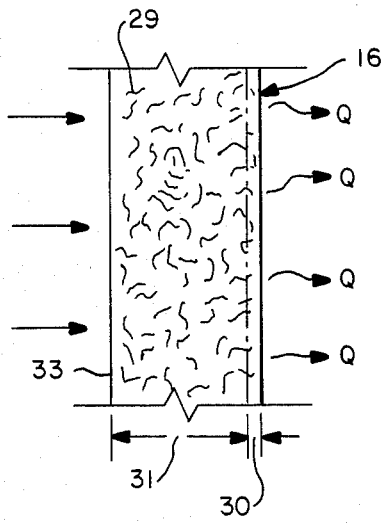
FIG. 4 is a fragmentary cross-section of the fiber matrix shell of the burner utilized in FIG. 1.

The fiber matrix composition of the burner shell has relatively poor internal heat conductivity so that the upstream portion 31 of the matrix forms a heat insulation barrier. As depicted in FIG. 4 this establishes a combustion reaction zone 30 along a shallow depth of only a few millimeters on the downstream side of the shell 16. The shallow depth of the reaction zone produces significant heat transfer outwardly from the zone to the combustion wall surfaces primarily by radiation with some transfer by convection. The rate of the radiative transfer is such that the surface temperature of the fiber material in the reaction zone is maintained below the adiabatic flame temperature of the fuel-air mixture and also below the "use" temperature of the fiber material. The substantially lower surface temperature of the matrix materials in the present invention thereby permits operation at near stoichiometric mixtures with relatively low $NO_x$ emissions and high combustion efficiencies as compared to firetube boiler burners of conventional design.

Figure 5:
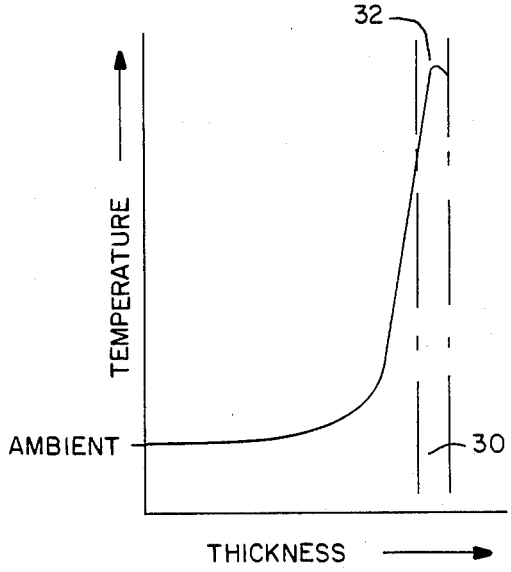
FIG. 5 is a chart depicting the approximate temperature profile within the fiber matrix as a function of depth through the thickness of the burner shell of FIG. 3.

An important feature of the invention is that the problem of combustion flashback into the incoming fuel-air mixture is minimized. The poor internal heat conduction of the fiber matrix and the shallow depth of the reaction zone prevents temperature rise on the surface at the inlet side which could otherwise lead to detonations and destruction of the burner. The approximate temperature profile for the burner shell of the invention is illustrated in the chart of FIG. 5. The temperature at the surface on the inlet side 33 and through the major depth of the layer is substantially ambient or close to the temperature of the incoming mixture. Approaching the combustion reaction zone 30 the temperature rises sharply to maximum at 32. Rapid transfer of heat by radiation from the downstream surface is represented by the down turn at the tail of the temperature curve. In addition, the cooling flow of reactants contributes to insulation of the inlet side of the burner from the combustion zone to prevent flashback and stabilize combustion on the burner surface. Because of the high radiant energy transfer from the fiber surface, the combustion temperature along combustion zone 30 is controlled to levels between 1,700° and 2,000° F. which correspondingly limits thermal $NO_x$ formation.

Figure 6:
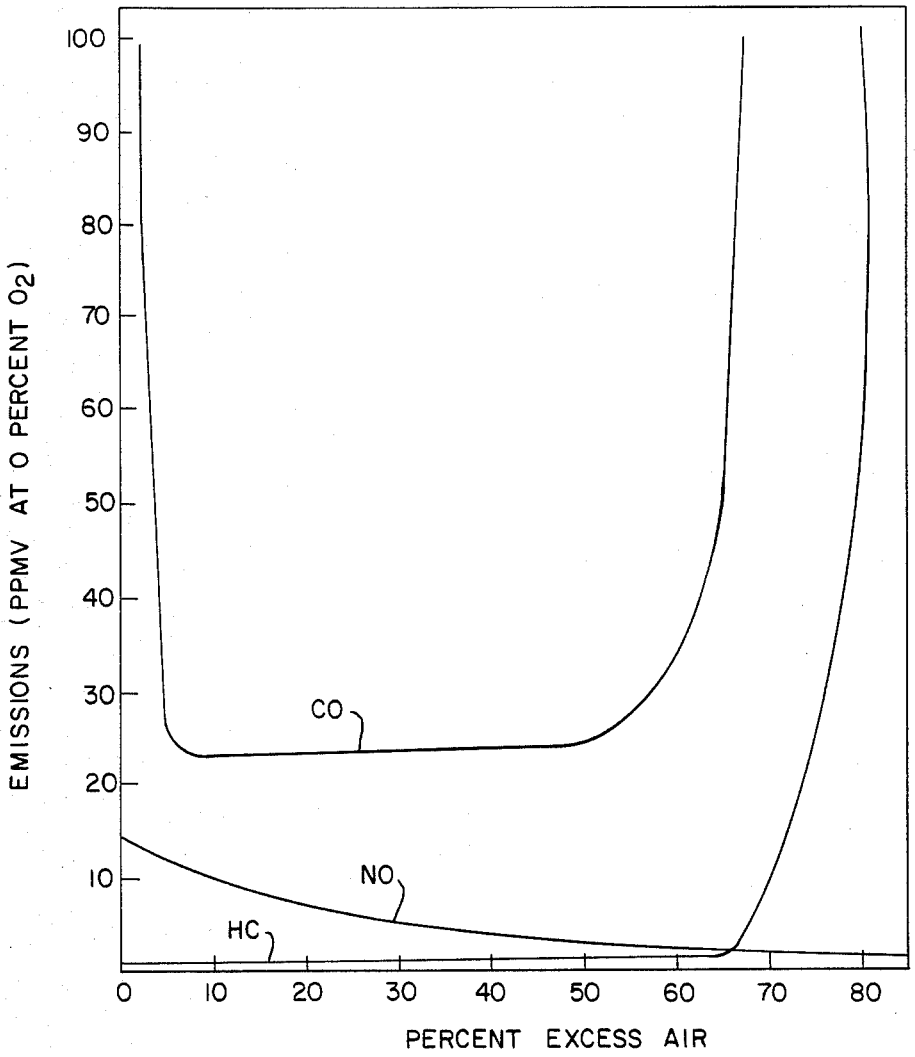
FIG. 6 is a chart depicting emissions as a function of excess air with the burner of the invention operating on natural gas fuel.

For the fiber burner of the invention the nominal heat release rate per unit burner surface is 80,000 Btu/hr-ft$^2$. Operation of this fiber burner with natural gas fuel at the nominal heat release rate produced the emission results depicted in FIG. 6 with CO, $NO_x$, and HC emissions plotted as a function of excess air. The chart shows that all of these emission species are less than 25 ppmv (on an air-free basis) at excess air levels between 15 and 55 percent. The burner can be turned up to achieve 120,000 Btu/hr-ft$^2$ heat release rate or down to 60,000 Btu/hr-ft$^2$ heat release rate. Operation outside these limits results in increased emissions of CO and $NO_x$.

The following example demonstrates the use and operation of the invention. The firing rates as set forth in the preceding paragraph determine the required burner surface area and occupied combustion chamber volume for a particular application of known firing rate. Applying these parameters a burner was constructed in accordance with the invention rated at $10^6$ Btu/hr heat input and sized for retrofit into a combustion chamber of a 25 hp York-Shipley firetube boiler having three passes producing steam at low pressure with an energy input at full load of 1,048,000 Btu/hr. This burner sizing approximately matches the burner heat release rate with the firewall absorption rate of the tube surface in the boiler's first pass. The fiber burner installed in the boiler had a maximum pressure drop of 1.5 inches w.g. with the existing blower being employed.

Figure 7:
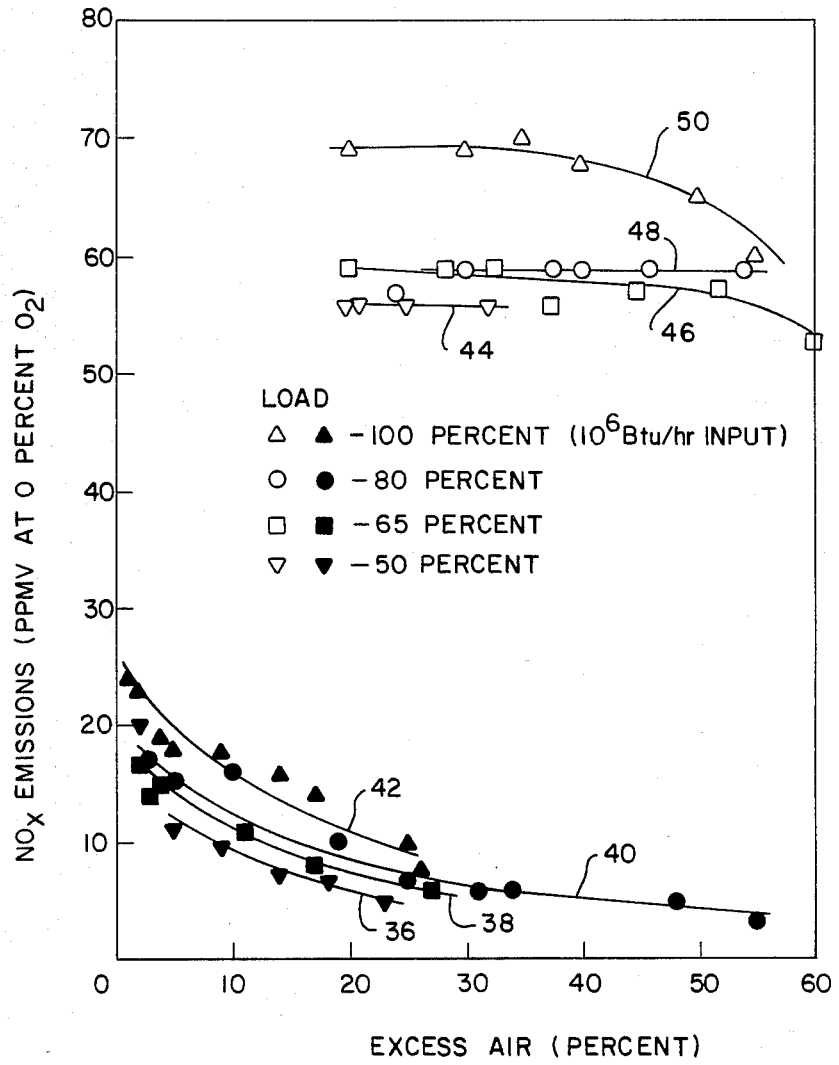
FIG. 7 is a chart depicting $NO_x$ emissions as a function of excess air for various boiler loads during operation of a boiler burner system incorporating the invention in comparison to a conventional burner.

The described burner system as assembled in the York-Shipley boiler was tested for $NO_x$ emissions as a function of excess air levels for various boiler loads using natural gas fuel. The operating results are depicted in the chart of FIG. 7 with the results for the different loads in the boiler incorporating the invention depicted by the family of curves 36, 38, 40 and 42. The test results during operation of the same boiler incorporating a conventional burner are depicted in the family of curves 44, 46, 48 and 50. These results show that the $NO_x$ emissions for the invention follow the trend established by the burner results in the chart of FIG. 6, that is the emissions increase with temperature such as when load increases or excess air decreases. The results showed a $NO_x$ reduction of approximately 50 ppmv for the invention in comparison to operation of the boiler with the conventional burner.

Figure 8:
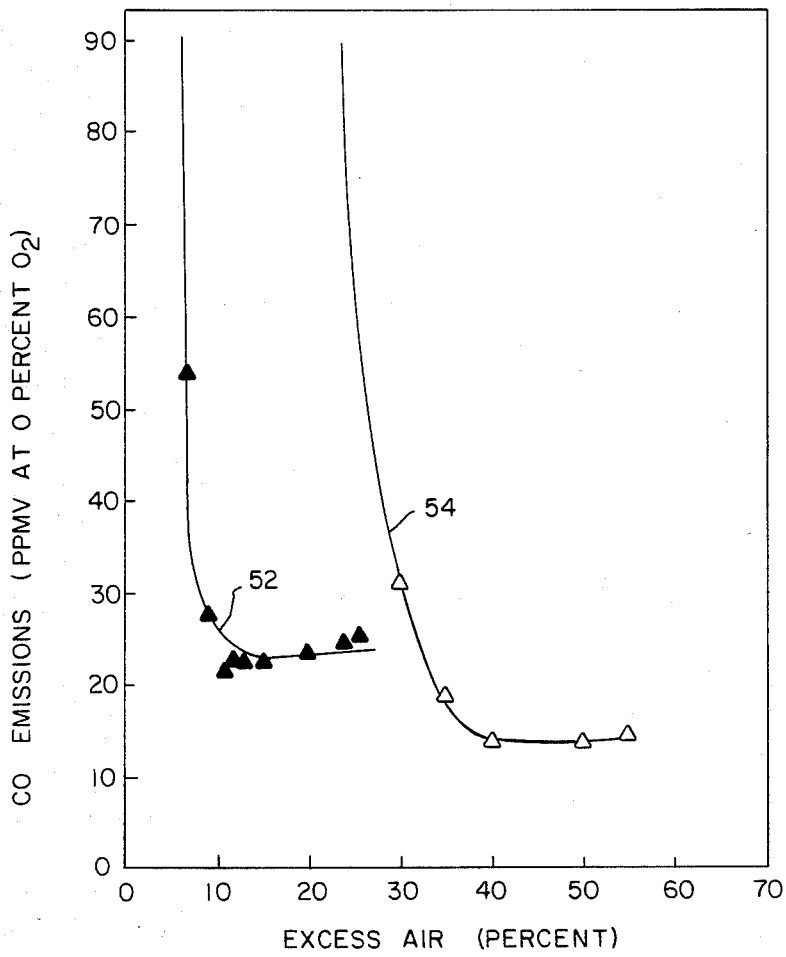
FIG. 8 is a chart depicting CO emissions as a function of excess air of a boiler system incorporating the invention in comparison to a conventional burner.

The CO emissions of the described boiler incorporating the invention compare favorably with the boiler incorporating the conventional burner as shown by the test results depicted in the chart of FIG. 8. In this chart CO emissions are plotted as a function of excess air at 100% load for each of the burners. The CO emissions from the burner of this invention are plotted on the curve 52 and the emissions for the conventional burner are plotted on the curve 54. As shown in these plots the knee in the CO-excess air curve occurs at 10% excess air for the invention and at 30% excess air for the conventional burner. Thus, the nominal operating points are 10% excess air for the invention and 30% excess air for the conventional burner.

Figure 9:
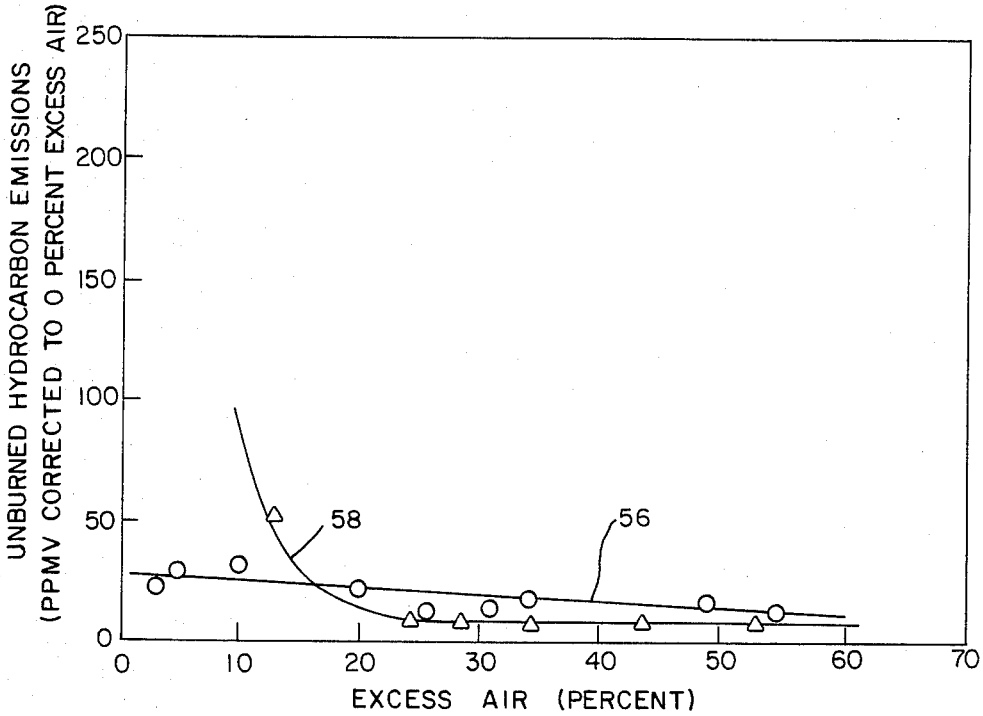
FIG. 9 is a chart depicting hydrocarbon emissions as a function of excess air during operation of a boiler system incorporating the invention in comparison to a conventional burner.

The chart of FIG. 9 shows a comparison of unburned hydrocarbon emissions for the boiler system incorporating the burner of the invention in comparison to the boiler incorporating the conventional burner. In this chart, curve 56 plots the unburned hydrocarbon emissions for the invention while curve 58 plots unburned hydrocarbon emissions of the conventional burner. The chart shows that both the burners at their nominal operating points have unburned hydrocarbon emissions less than 30 ppmv.

Figure 10:
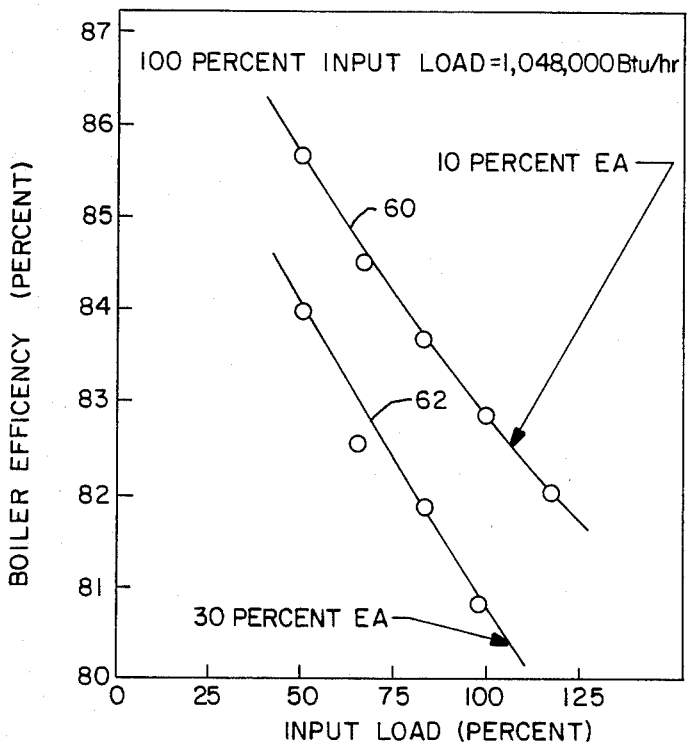
FIG. 10 is a chart depicting boiler efficiency as a function of input load during operation of a boiler system incorporating the invention in comparison to a conventional burner.

The chart of FIG. 10 depicts the comparative efficiencies of the described boiler system incorporating the invention (curve 60) and the boiler system incorporating the conventional burner (curve 62), both at their nominal operating conditions. The boiler efficiency calculations were made in accordance with ASME Power Test Code 4.1 Heat Loss Method. As shown in this chart there is a boiler efficiency increase for the invention of approximately 2% over the conventional burner, and this is a result of the invention's ability to transfer more heat through radiation and to operate at 10% excess air without producing high CO emissions. In addition, because the boiler was designed to operate with 30% excess air, the fiber burner of the invention can be overfired by 20% with a high boiler efficiency. This highlights an advantage of the invention, that is the ability to operate at higher than rated capacity with good efficiency and lower emissions.

Table I sets forth a comparison of the performance between the fiber burner of the invention and that of the conventional burner used in the described 25 hp York-Shipley firetube boiler. This table shows a 77% reduction in $NO_x$ emissions with the invention over that of the conventional burner, and this was accompanied by a 2% increase in boiler efficiency. These results demonstrate the applicability of the invention for use with gas-fired firetube boilers with significant potential for air quality improvement where the burner is capable of retrofit into existing effective boiler systems.

TABLE I

| | Fiber Burner | Conventional Burner |
|---|---|---|
| Nominal operating point | 10% EA | 30% EA |
| Full load emissions at nominal operating point: | | |
| $NO_x$ | 16 ppmv | 69 ppmv |
| CO | 25 ppmv | 31 ppmv |
| HC | 22 ppmv | 10 ppmv |
| Full load efficiency | 82.6% | 80.9% |
| Overfire capability | Yes | No |

What is claimed is:

1. A burner for use in a heater having a combustion chamber with firetube walls, the burner including the comination of a burner shell comprised of a matrix of ceramic fibers having interstitial spaces between the fibers providing a flowpath for an air-fuel mixture with combustion of the mixture occurring in a reaction zone along a shallow outer layer of the shell whereby heat transfers primarily by radiation from the reaction zone outwardly to the firetube walls of the combustion chamber, mounting means for supporting the burner shell and for mounting the shell in the heater wherein said burner shell is separable and detachable from the combustion chamber, and with the reaction zone spaced from and in direct line of radiant view with the firetube walls of the combustion chamber, and means for directing a flow of the air-fuel mixture into the shell and outwardly through the fiber matrix.

2. A burner as in claim 1 in which the fibers of the matrix are comprised of substantial portions of alumina and silica.

3. A burner as in claim 2 in which the matrix includes a refractory metal compound.

4. A burner as in claim 3 in which the refractory metal compound is aluminum.

5. A burner as in claim 1 in which strands of a catalytic metal are interspersed through the matrix.

6. A burner as in claim 1 in which the matrix is comprised of at least two layers with one layer on the upstream side of the direction of flow and a second layer on the downstream side of the direction of flow with the layer on the upstream side formed of a composition which is less catalytically active than the layer on the downstream side for minimizing flashback of combustion through the shell.

7. A burner as in claim 1 which includes a centerbody mounted within and radially spaced from the inner surface of the shell to form a flow annulus therebetween, and means forming apertures through the centerbody for directing the flow of mixture into the annulus for maintaining a high velocity flow of the mixture into the shell.

8. A firetube heater system of apparatus comprising the combination of a combustion chamber having firetube wall surfaces, a burner shell mounted within the chamber and separate and detachable therefrom, said shell being radially spaced from and in direct line of radiant view with the firetube wall surfaces, said burner shell comprising at least one layer of ceramic fiber matrix with interstitial spaces between the fibers providing a flowpath for an air-fuel mixture with combustion of the mixture occurring in a shallow reaction zone along the outer surface of the shell with heat transferring primarily by radiation from the reaction zone outwardly to the firetube wall surfaces, and means for directing a flow of the air-fuel mixture into the shell and outwardly through the fiber matrix.

9. A heater system as in claim 8 which includes mounting means for the burner shell in the combustion chamber as a replacement for a conventional burner therein.

10. A method for combusting an air-fuel mixture for heating the firetube wall surfaces in a heater having a combustion chamber with firetube walls, and a burner shell separate and detachable from the firetube walls, comprising the steps of directing a flow of the mixture through interstitial spaces in a matrix of ceramic fibers, forming the burner shell, combusting the mixture at a shallow reaction zone on a side of the matrix downstream of the flow, and radiating heat from the reaction zone directly to the firetube wall surfaces at a rate which maintains the temperature of the matrix in the zone below the adiabatic flame temperature of the mixture and also below the use temperature of the fibers.

11. A method as in claim 10 in which heat conduction from the reaction zone through the matrix in a direction upstream of the flow is at a rate which maintains the temperature of the upstream side of the matrix below the ignition temperature of the mixture for preventing flashback into the upstream flow of gases.

* * * * *